United States Patent [19]

Anderson

[11] Patent Number: 4,925,194

[45] Date of Patent: May 15, 1990

[54] BOARD GAME APPARATUS PLAYING PIECE AND METHOD OF PLAY

[76] Inventor: David M. Anderson, 13412 - 25th Avenue, White Rock, British Columbia, Canada, V4A 6C1

[21] Appl. No.: 358,662

[22] Filed: May 30, 1989

[51] Int. Cl.[5] ..... A63F 3/00

[52] U.S. Cl. ..... 273/271; 273/236; 273/288

[58] Field of Search ..... 273/236, 271, 288, 275

[56] References Cited

U.S. PATENT DOCUMENTS

| | | | |
|---|---|---|---|
| D. 57,430 | 3/1921 | Gore . | |
| D. 217,974 | 7/1970 | Deitch . | |
| 1,425,464 | 8/1922 | Fischer | 273/263 |
| 3,788,645 | 1/1974 | Nelson | 273/156 |
| 3,873,101 | 3/1975 | Kelly . | |
| 3,881,731 | 5/1975 | Droney . | |
| 4,074,907 | 2/1978 | Curtis | 273/273 |
| 4,124,213 | 11/1978 | Kaplowitz | 273/288 X |
| 4,335,879 | 6/1982 | Wiskur | 273/260 |
| 4,357,018 | 11/1982 | Calvert | 273/261 |
| 4,391,449 | 7/1983 | Johnson | 273/260 |
| 4,580,787 | 4/1986 | Baker | 273/261 |
| 4,678,192 | 7/1987 | Campbell | 273/157 R |
| 4,688,802 | 8/1987 | Sandifer | 273/261 |
| 4,779,875 | 10/1988 | Sypal | 273/261 X |
| 4,788,187 | 10/1988 | Deak, Jr. | 273/261 |

*Primary Examiner*—Anton O. Oechsle

*Attorney, Agent, or Firm*—Merchant, Gould, Smith, Edell, Welter & Schmidt

[57] ABSTRACT

A game consisting of a game board with thirty six identical playing pieces and one control playing piece. The board comprises thirty seven spaces. Cube shaped playing pieces have six arrangements of four colors on the six sides which allows a choice of twenty four possible ways to orient the playing pieces onto the spaces on the board to achieve player advantage.

17 Claims, 5 Drawing Sheets

FIG. 5
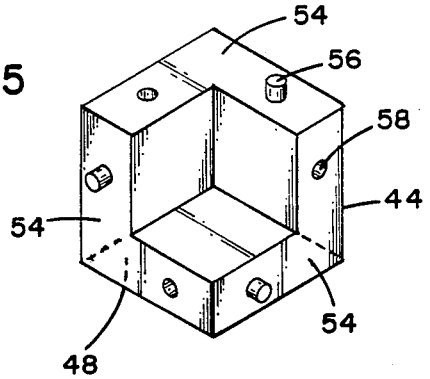
FIG. 3A
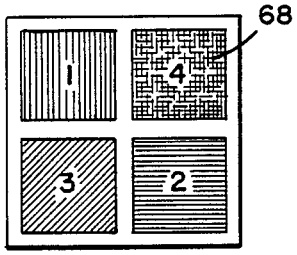
FIG. 3B
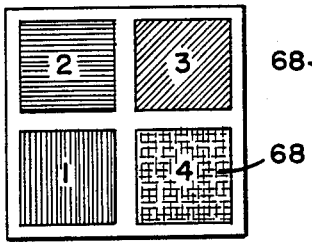
FIG. 3C
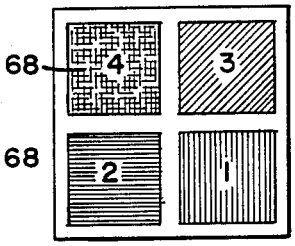
FIG. 3D
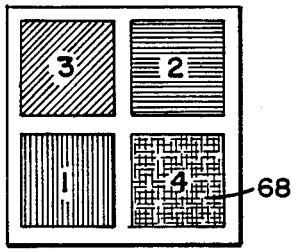
FIG. 3E
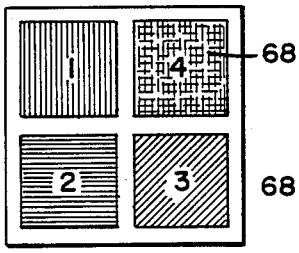
FIG. 3F
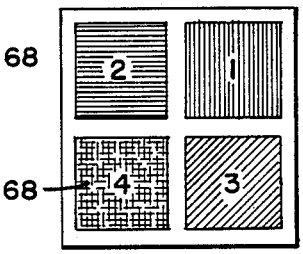
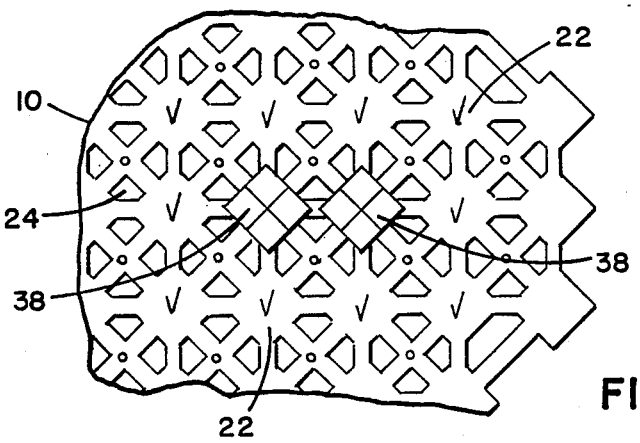
FIG. 6

BOARD GAME APPARATUS PLAYING PIECE AND METHOD OF PLAY

TECHNICAL FIELD OF THE INVENTION

The present invention relates generally to a board game and more particularly to a board game using cubic playing pieces.

BACKGROUND OF THE INVENTION

Numerous board games exist which employ playing pieces. However, the combination of a board game which utilizes cubic playing pieces having colored patterns on each side and which are placed individually by players on the game board and then re-oriented into scoring rows during subsequent play has not heretofore been shown. Thus, a game of strategy which employs said game pieces so that players may trap opposing player's pieces and reorient the opposing player's pieces for scoring advantage has been needed. The present game allows two or more players the opportunity to practice stratagems in a gaming scenario and to outscore opposing players by selective reorientation of colored playing pieces in rows.

SUMMARY OF THE INVENTION

Method and apparatus is provided for a board game whereby each player may in turn position playing pieces for scoring advantage through orienting rows of playing pieces so that a color of a designated portion of each playing piece is aligned favorably with a player's selected game color. A game board is provided with a playing surface having indicia including colored peripheral regions which denote individual player locations and assigned game colors, and a symmetric pattern of playing piece placement spaces defined by a plurality of separation regions which are arranged so that the playing piece placement spaces are linearly oriented to form rows of placement spaces. A plurality of playing pieces are provided and sized for selective placement on the game board playing surface placement spaces. Each playing piece preferably comprises six sides with each side having a colored pattern comprising multiple colors. A control playing piece is provided and shaped for placement on a playing piece placement space. The control playing piece is used for controlling priority of player moves and for placement within a row of playing pieces located on placement spaces.

BRIEF DESCRIPTION OF THE DRAWINGS

FIGS. 3A–3F each illustrate one of six possible color pattern combinations of each side of a preferred playing piece.

FIG. 5 is a perspective illustration showing the inner surfaces of a corner section of a six sided playing piece according to the present invention.

FIG. 6 is a top plan view of a board section according to the present board game invention with next available playing piece placement spaces for play indicated by a check mark.

DETAILED DESCRIPTION OF THE INVENTION

As required, detailed embodiments of the present invention are disclosed herein. It is to be understood, however, that the disclosed embodiments are merely exemplary of the invention, which may be embodied in various forms. Therefore, specific structural and functional details disclosed herein are not to be interpreted as limiting, but rather as a basis for teaching one skilled in the art to variously employ the present invention in virtually any appropriately detailed system or structure.

Figure 1:
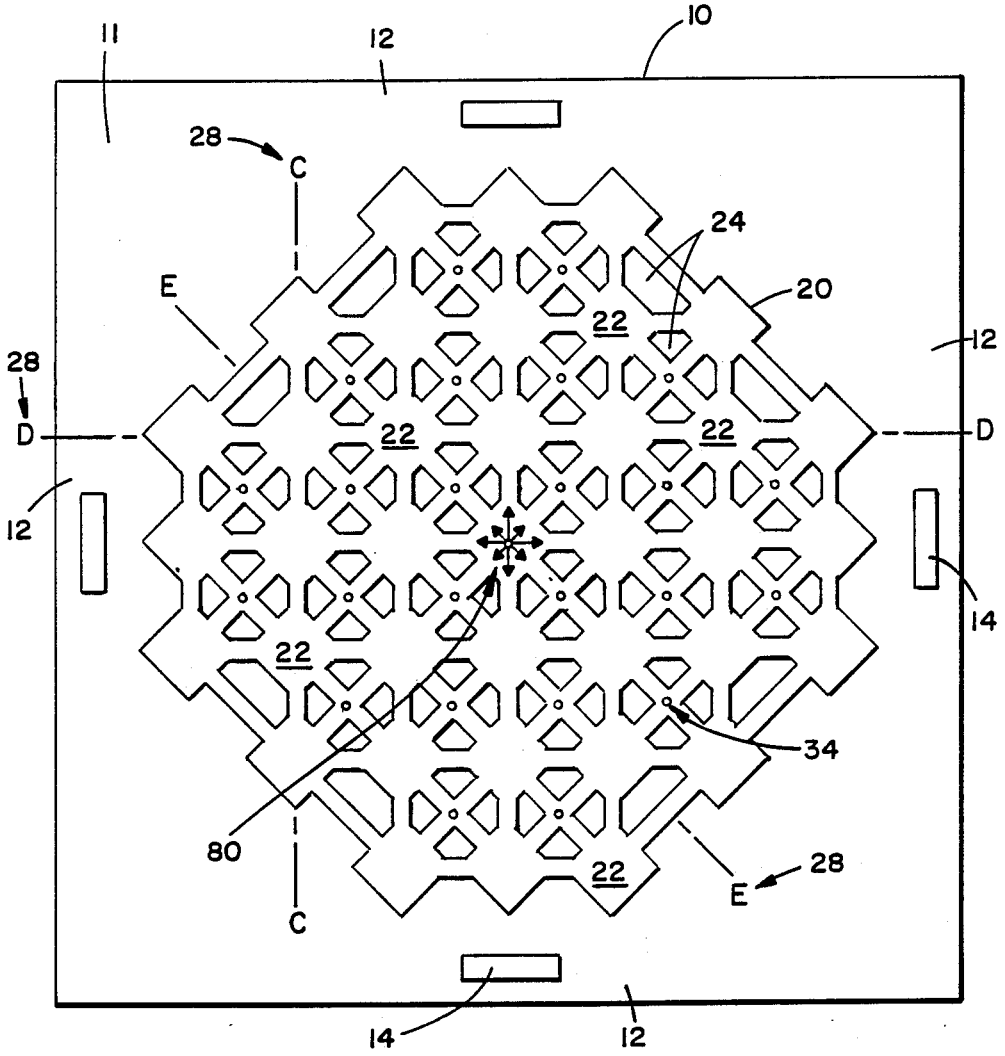
FIG. 1 is a top plan view of a board and board indicia of the present invention.

Referring to FIG. 1, a game board 10 is illustrated. As shown, game board 10 is arranged as a four sided substantially two dimensional game board with an upper surface 11 around which players are located. It is understood that although game board 10 is illustrated with locations for one to four players, variations within the scope of this invention include greater numbers of players using slightly modified board shapes or additional player location designations. Game board 10 includes outer peripheral regions 12 generally forming the outer periphery of game board 10. Outer peripheral regions 12 may also comprise colored peripheral regions 14, or colored patches, or other designs, therein. Further indicia on game board 10 upper surface 11 includes an inner pattern 20, and preferably a symmetric pattern as shown. Pattern 20 includes a plurality of playing piece placement spaces 22 generally defined by a plurality of separation regions 24. Although the precise number of playing piece placement spaces 22 (also referred to herein as die placement spaces 22) may vary according to the embodiment of game board 10 utilized, a preferred embodiment as shown in FIG. 1 comprises a game board 10 having thirty seven die placement spaces 22. Additionally, separation regions 24 are arranged on game board 10 to preferably provide substantially square shaped die placement spaces 22 that are linearly oriented to form rows 28 of die placement spaces 22. For example, as shown in FIG. 1, lines C—C, D—D, and E—E, each represent a row 28 of die placement spaces 22. Thus, as illustrated, rows 28 may be vertically, horizontally, or diagonally oriented in relation to each player and to adjacent rows 28.

Game board 10 may also comprise indicia that, during the game play, provides means of increasing a player's score. Such indicia includes a plurality of high scoring zones 34. High scoring zones 34, which will be later discussed in relation to actual game play, are located on game board 10 between four adjacent separation regions 24.

Figure 2:
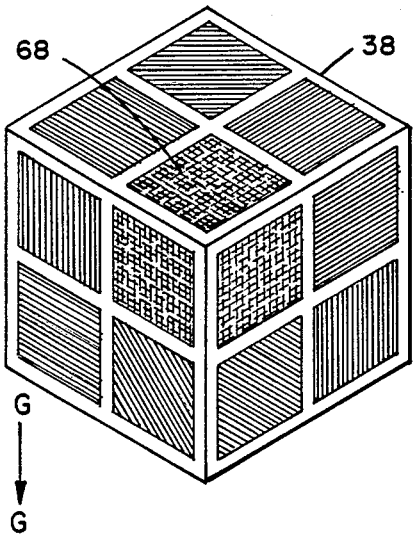
FIG. 2 is a perspective illustration of a six sided playing piece having a colored pattern of four different colors on each side.

An object of the present game is the orientation of rows of playing pieces to accumulate points for players. Referring now to FIG. 2, a playing piece 38 is shown which may be utilized with game board 10. More particularly, a plurality of cubic die shaped playing pieces 38 are provided for selective placement or deposit on game board 10 playing surface 11 placement spaces 22. Each preferred cubic die playing piece 38 comprises six sides. Preferably, each die playing piece side has a colored pattern comprising four different colors. In the perspective view of FIG. 2, three sides of cubic die playing piece 38 are shown. As illustrated, each of those three sides has a four color pattern that is different from any other side pattern on the same cubic die playing piece. As will be later shown during method of play, the particular orientation of the top facing side 40 of each playing piece will determine whether or not the playing piece is oriented properly for scoring advantage of any particular player. The scoring advantage is determined by the player's selected game color and the orientation of the colors in the colored pattern on top facing side 40 of the particular die playing piece 38. Moreover, although various colors or patterns or shades of material may be utilized to form a colored pattern, the colors red, green, blue, and yellow are preferable colors according to the present invention. Cubic die playing piece 38 may comprise a colored pattern on each side which has been printed, screen printed, engraved, or decalled. Each of the six sides of each cubic die playing piece 38 displays one of six possible arrangements of the four colors in relation to each other. Accordingly, each side of a six sided cubic die playing piece 38 may be played in one of four different ways depending on the particular colored pattern on that side.

FIGS. 3A–3F further illustrate the six possible arrangements of four colors in relation to each other which comprise the colored patterns on cubic die playing piece 38. As shown in FIGS. 2 and 3A–3F, the colored pattern is arranged so that a corner perspective view of cubic die playing piece 38 reveals identical colors at three surfaces of the corner view. In other words, the colored patterns are arranged as six patterns or combinations which are sequentially organized to give a corner view of three identical colors merging at corner portions of cubic die playing piece 38. This arrangement permits a player to orient the colors on a cubic die playing piece 38 top facing side 40 in one of four different configurations, depending on which color is facing the player.

Figure 4A:
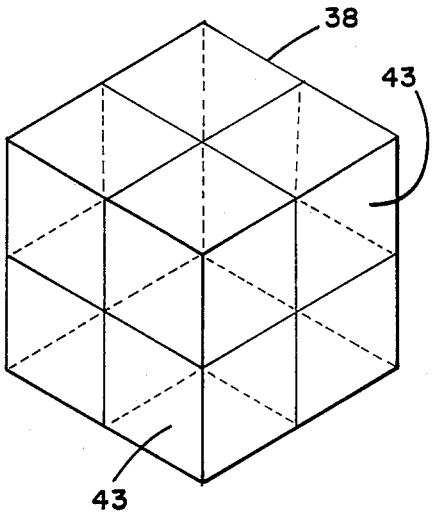
FIG. 4A is an assembled perspective view of a six sided cube analogous to that illustrated in FIG. 2 and which is constructed of eight cubic corner sections.
Figure 4B:
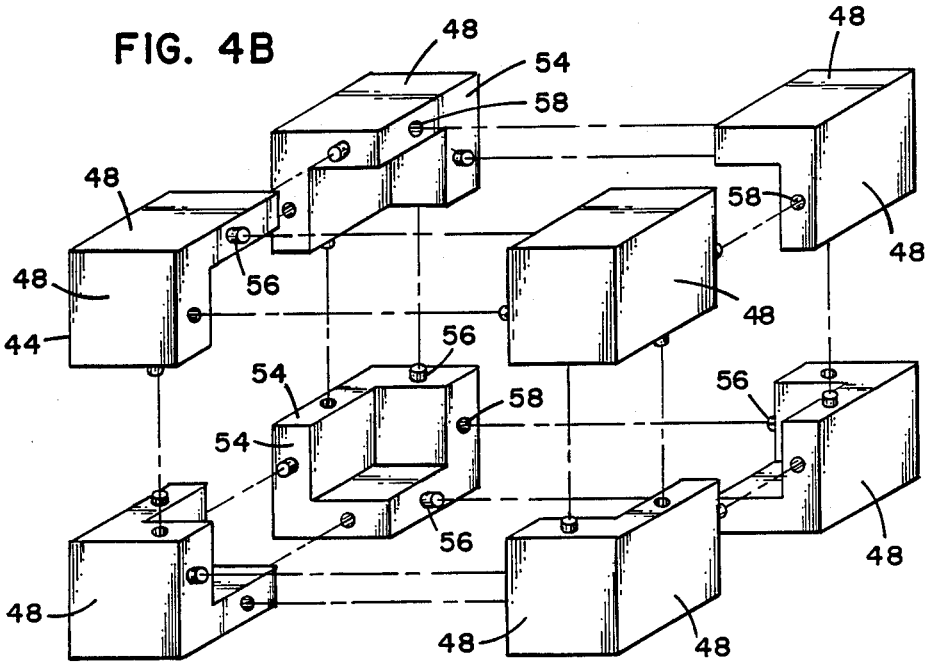
FIG. 4B is an exploded perspective view of a six sided cube analogous to that illustrated in FIG. 2 and which is constructed of eight corner sections having snap-fit construction.

Although many embodiments of playing pieces could be employed within the scope of this invention, a preferred playing piece comprises cubic die playing piece 38 which is preferably a plurality of cubic corner sections 43, as shown in the assembled view of FIG. 4A. Cubic corner sections 43 may be assembled by adhesive means, sonic welding, or the like. Another preferred construction for playing piece 38 includes a number of interlocking or snap-fit corner sections 44 as shown in FIG. 4B. In a cubic die playing piece 38 there are preferably eight corner sections 44 which comprise a preferred construction. Thus, two corner sections 44 of each color provide the eight piece composite cube with the six arrangements of colored pattern per side. This is illustrated by the patterned shadings of FIG. 2. Referring again to FIG. 4B, a playing piece structure is shown whereby corner sections 44 may be readily assembled into a cubic die playing piece 38. The structure shown in FIG. 4B comprises a cubic die playing piece 38 having outer surfaces 48 and inner surfaces 54. Inner surfaces 54 of each corner section 44 preferably comprise at least one protruding dowel-like member, or post, and at least one receiving aperture, or hole, for receiving the protruding member therein. A preferred construction according to the present invention comprises playing piece inner surfaces 54 having multiple protruding posts 56 and multiple receiving apertures 58 located in opposing relation to posts 56.

Referring to FIGS. 4B and 5, it may be seen how each corner piece 44 comprises three outer surfaces 48 which form outer sides of cubic die playing piece 38. The structure further includes the dowel-like post 56 and receiving aperture 58, both of which are preferably located on inner surfaces 54 of corner sections 44. Thus, it is seen how each corner piece 44 is a three sided piece with posts and apertures to allow each corner section to be readily assembled with other corner sections to form cubic die playing piece 38. Means for retaining corner sections 44 together may include snap-fit sizing of posts and apertures, adhesives applied to the posts and inner surfaces, or other means as deemed suitable. This preferred construction corner section 44 permits ease of manufacture through various processes, although injection molding utilizing four different colors provides excellent efficiency in this manufacture. FIGS. 2 through 4B further illustrate the manner in which the playing piece outer surfaces 48 of corner sections 44 each comprise approximately one quarter of the surface area of each of three sides of the cubic die playing piece 38.

The present invention provides apparatus and method for playing a game of skill and strategy. This game, which has been distributed under the trade name of Quadri TM provides players with a gaming medium within which to practice flanking maneuvers on one's opponent and to practice various other tactics. As discussed herein, the game consists preferably of 36 identical cubic die playing pieces 38 and preferably one control playing piece 62, also referred to as a "wild" cube 62, and a board 10 having indicia including thirty seven placement spaces 22 located on a board playing surface 11. The multi-sided playing pieces have arrangements of colors in a colored pattern on each side to allow a choice of possible ways to orient the playing piece relative to a player's position around game board 10. Preferably, the playing pieces comprise cube shaped playing pieces 38 having six patterns each with four colors. One pattern is located on each of the six sides. This permits a choice of twenty four possible ways to place the cube from a player's position, e.g., six sides times four colors. The object of the game is to place or rotate the game pieces 38 to a player's advantage. Points are earned at the completion of play by having a player's color patch 68, as shown in FIGS. 2 and 3 and generally represented by one of the four colors in the colored pattern on top facing side 40 of a playing piece, facing that player. For example, if color patch 68 shown in FIG. 2 was a red color, and the game player having a game color of red was located relative to patch 68 as shown in the arrow labelled G—G, then that red player would be able to count a point for that playing piece as appropriate.

Although various numbers of players may participate in the game described by this invention, the preferred number of players is either two, three, or four. When using the preferred embodiment and with two players, each player deposits eighteen cubic playing pieces 38. When there are three players participating then each player deposits twelve cubic die playing pieces 38, and four players would each deposit nine playing pieces. Also, when four players are involved, play may evolve around each player individually or two pairs of players may participate as teams. When team play occurs, it is preferable to have partners sitting across from each other at game board 10 and to total their scores at the end of play. In preparation for play, players each choose a color on game board 10 and are seated with that color in front of them. For example, as shown in FIG. 1, each player would chose one colored peripheral region 14 as his game color and then position himself at the side of the board along outer peripheral region 12 which includes the selected colored peripheral region 14. The play may then proceed as agreed by the players, although a clockwise direction is preferred.

The first move is determined by rolling the control playing piece 62, hereinafter referred to as the wild cube 62. Four of the sides of cube 62 are each provided with a different one of the four player colors. The first player to roll his own color (that color chosen by him and which matches his selected colored peripheral region 14) starts the game. Wild cube 62 is deposited on center space 80 of game board 10 as shown in FIG. 1. That player decides which of the six sides he wants to have facing upwards, then places his playing piece 38 on a placement space 22 adjacent or connected to center space 80 beneath wild cube 62. Once a playing piece has been deposited on game board 10, it cannot be lifted to expose a different side. Rather, the playing piece may only be rotated or reoriented in subsequent play. A player is not required to have his own game color facing him as a result of reorienting or initially depositing a playing piece. This option permits each player to employ tactics which will be more readily understood further in this description. Thus, the orientation of the colored pattern of color patches 68 on top facing side 40 of a playing piece may initially favor an opponent with the opponent's own color directed toward him for strategic reasons.

Each player in turn places a playing piece 38 on a die placement space 22 which is connected or immediately adjacent to a previously played cubic die playing piece 38 or control playing piece (wild cube) 62. FIG. 6 illustrates a fragment of game board 10 with indicia arranged in a preferred embodiment. The indicia includes a number of die placement spaces 22 defined by separation regions 24. FIG. 6 illustrates two cubic die playing pieces 38 placed on die placement spaces 22, and it shows connected and immediately adjacent die placement spaces 22 designated by check marks which are permissible die placement spaces for subsequent depositing of other game playing pieces. Thus, FIG. 6 illustrates that the deposition of playing pieces 38 onto game board 10 must be in a connected manner so that rows of playing pieces 38 may thus be formed without any unused die placement spaces 22 within such a row.

As previously explained, the object of the present game invention is to encourage each player to maneuver playing pieces 38 so that the color of each player's colored peripheral region, or game color, matches the color of the color patch 68 which is facing the particular player when all cubic die playing pieces 38 have been deposited on game board 10. Thus, it is necessary throughout the game for players to reorient or rotate the playing pieces. For example, if a player places his playing piece 38 so that he has outflanked or trapped other playing pieces in a straight line or row between his playing piece 38 and another playing piece 38, and if his game color is oriented toward the player, then he may reorient or rotate the "trapped" playing pieces to his advantage. The rows thus formed may be horizontal, vertical, or diagonal in relation to the player. It is preferable that certain restrictions apply so that the end playing pieces of the row thus formed must favor the player placing the pieces in order for that player to be permitted to reorient the trapped playing pieces 38 within the row.

Figure 7:
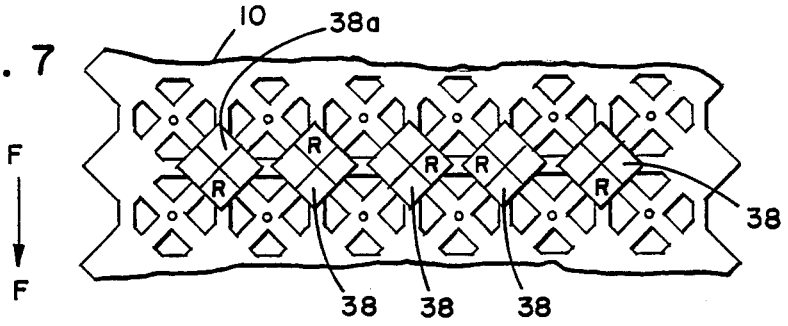
FIG. 7 is a top plan view of a row of cubic playing pieces having top facing side colored patterns that are not uniformly oriented.
Figure 8:
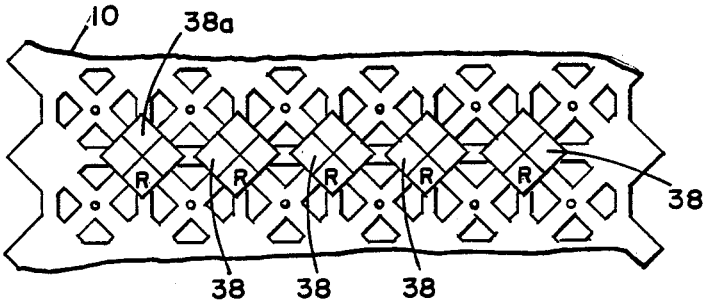
FIG. 8 is a top plan illustration of a row of cubic playing pieces generally analogous to FIG. 7 but with the colored pattern on the top facing side of each playing piece oriented uniformly with the other playing piece patterns in the row.

Referring to FIG. 7, a row of cubic die playing pieces 38 has been formed by depositing the playing piece labelled **38*a* on game board 10. As illustrated, the remaining cubic die playing pieces 38 each have red color patches 68 designated by the letter R which are oriented in different directions relative to the red player who is located in the direction of arrow F—F. The orientation of deposited cubic die playing piece 38*a* is such that the red color patch R of that playing piece is oriented toward the red player and is at the end of a row formed by another playing piece 38 with a similarly oriented red color patch on top facing side 40. Thus, the red player would receive advantage and be permitted to reorient all playing pieces within the row formed by the playing pieces at the end of the row and which initially favor the red player by orientation of their top facing side 40 red color patches 68. Therefore, FIG. 8 illustrates the row of cubic die playing pieces 38 and 38*a* shown in FIG. 7 after reorientation in favor of the red player. If the cubic die playing piece 38*a* had been the final playing piece to be deposited on game board 10, then its deposition would have resulted in a scoring advantage for the red player due to the reorientation of the row towards him. However, if playing piece 38*a* was not the final playing piece employed in the game, then the entire row may be subsequently reoriented and the red player might not receive the score based on the move described in FIGS. 7 and 8**.

Figure 9:
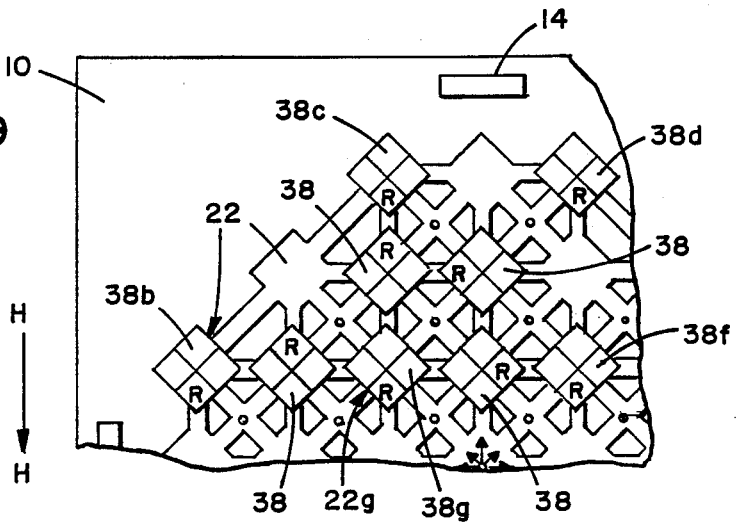
FIG. 9 is a top plan view of a playing board section illustrating multiple rows of playing pieces.
Figure 10:
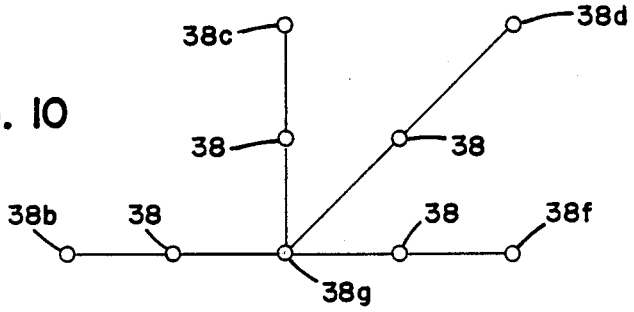
FIG. 10 is a line diagram depiction of the rows of playing pieces illustrated in FIG. 9.
Figure 11:
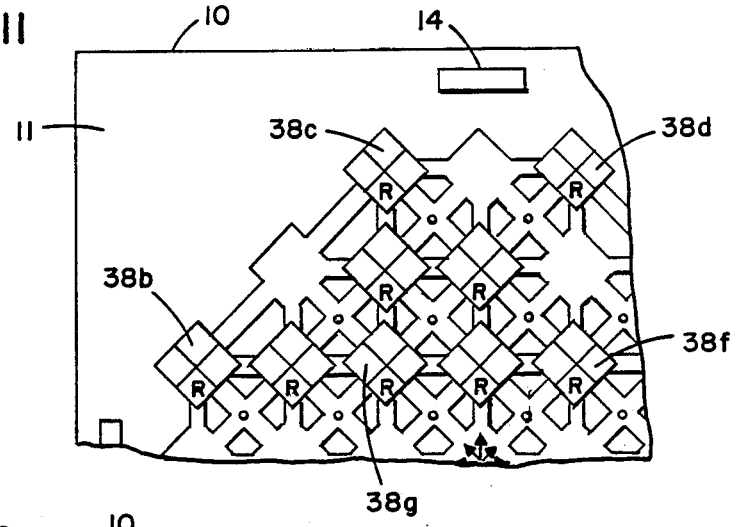
FIG. 11 is a top plan view of a game board section generally analogous to FIG. 9 but with a uniform orientation of colored patterns on the top facing side of each playing piece.

Multiple rows may be made by one placement or deposition of a playing piece 38. These rows must be a direct result of a placement and not the result of rows which become apparent as the result of rotated playing pieces 38. Referring to FIG. 9, a game board 10 is partially shown with a number of cubic die playing pieces 38 deposited on die placement spaces 22 on playing surface 11. FIG. 9 represents the status of the game after placement or deposition of cubic die playing piece **38*g* onto previously unoccupied die placement space 22*g* therebeneath. Placement of cubic die playing piece 38*g* resulted in the formation of multiple rows at one time, all of which favored the red player located in the direction of arrow H—H. As illustrated in FIG. 9 and schematically depicted in FIG. 10, there are four rows of cubic die playing pieces 38 that may be reoriented following placement of playing piece 38***g*. These rows are formed by the red player oriented playing piece 38*g* in combination with row end playing pieces that are also oriented in favor of the red player and that are designated 38*b*, 38*c*, 38*d*, and 38*f*. FIG. 11 is analogous to FIG. 9 after reorientation of cubic die playing pieces 38 in each of the rows formed by placement of playing piece 38*g* by the red player.

Figure 12:
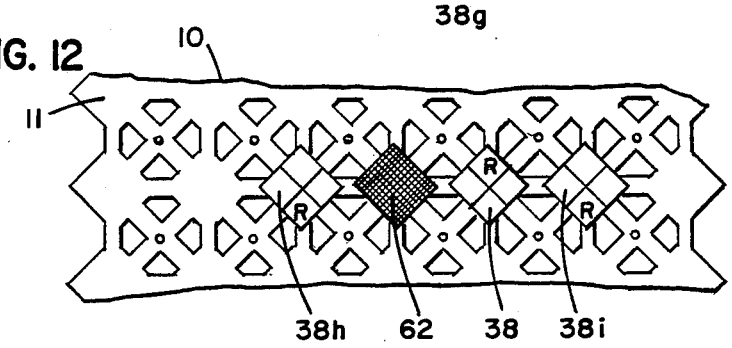
FIG. 12 is a top plan view of a row of game playing pieces formed by depositing the control playing piece into a vacant die placement space within the subsequently formed row.
Figure 13:
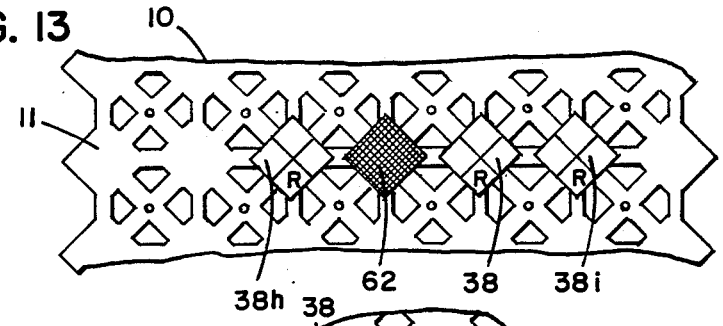
FIG. 13 is a top plan illustration generally analogous to FIG. 12 but with a uniform orientation of colored patterns on each playing piece top facing side.

It should be understood that, preferably, wild cube 62 may be used as a bridge in a row but not as a playing piece at an end of a row. FIG. 12 illustrates the proper use of wild cube 62 within a row. For example, the placement of playing piece 38*h* on the die placement space to the left of wild cube 62 effectively placed wild cube 62 within the row formed between cubic die playing piece 38*h* and cubic die playing piece 38*i*. This is an example of using wild cube 62 as a bridge rather than an end of a row. FIG. 13 is analogous to FIG. 12 following reorientation of cubic die playing piece 38 into alignment with cubic die playing pieces 38*h* and 38*i* in the combined row including control playing piece or wild cube 62.

Preferably, a player may not jump her own color to create a row, thus a playing piece 38 played to an opponent's advantage, i.e., oriented toward an opponent's color, may block or prevent the opponent from rotating a row when the opponent's turn arrives. Also, a player who does not place her own color to her own advantage during her placement opportunity would not be able to rotate any playing pieces 38 during that turn. If no rows can be created by a placement or deposition of a playing piece 38, or the player elects not to create a row, she may place her cubic die playing piece 38 on any die placement space 22 connected to a previously played cubic die playing piece 38 or wild cube 62. If a first player does not notice all of the rows her placement has created, and a second player has placed his playing piece, the possible rotations or reorientations of playing pieces that were available to the first player are forfeited.

Figure 14:
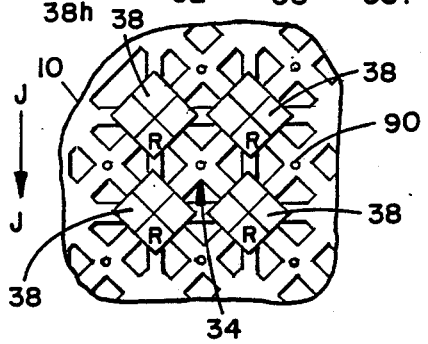
FIG. 14 is a top plan view illustrating four adjacent and oriented playing pieces surrounding a game board high scoring zone.

Finally, when all playing pieces have been played or deposited onto game board 10 then the players count the playing pieces which have color patches 68 oriented to their own advantage. Some playing pieces 38 may count for more than one player. Also, preferably, wild cube 62 is not counted as a scoring playing piece. This game provides further dimension and player excitement by employment of high scoring zones on game board 10. These high scoring zones may be designated in a number of ways. Preferably, game board indicia includes circular markings or dots 90 which indicate the location of a high scoring zone 34. As illustrated in FIG. 14, if a player has encircled one of dots 90 denoting a high scoring zone 34 with four playing pieces 38 that are oriented for scoring advantage, that player may receive bonus points for each high scoring zone 34 thus encircled. One additional bonus point per dot 90 encircled is preferable. Further, wild cube 62 may be employed as one of the encircling playing pieces for the purpose of achieving bonus points described above. In FIG. 14, the red player is located in the direction of arrow J—J and each of the encircling playing pieces 38 are oriented with red color patches facing toward the red player. Thus, the red player would receive bonus points if the view of FIG. 14 exists at the time when scoring is tallied.

In the event of a tie score, the players who tied may continue the game by removing playing pieces 38 of their own choice in turn until they each have a predetermined number of playing pieces. The removed playing pieces are then replayed and a new score is determined. This tie breaking procedure may be repeated until a winner is determined. The winner has the highest total of regular and bonus points achieved through superior placement tactics.

Therefore, a method is provided for playing a board game wherein the game comprises a game board 10 with a playing surface 11 having indicia including four colored peripheral regions 14 denoting individual player locations and assigned game colors. A symmetric pattern of die placement spaces 22 is defined by a plurality of separation regions 24, with the separation regions 24 being arranged so that the die placement spaces 22 are linearly oriented to form rows of die placement spaces. Also, a plurality of cubic die playing pieces 38 are included and sized for selective placement on game board 10 playing surface 11 die placement spaces 22. Preferably, each die playing piece 38 comprises six sides with each side having a colored pattern comprising, preferably, four different colors. A control playing piece 62 is provided and shaped for placement on a die placement space 22 and is used for controlling priority of player moves and for placement within an open row of playing pieces located on die placement spaces 22. The method of play comprises the steps of each player selecting one of the four colored peripheral regions 12 on game board 10 and self locating so that the selected region is in front of that player, and then all players determine the sequence of player moves. The next step includes the first player depositing control playing piece 62 on a die placement space at the center of game board 10 with the colored pattern of the top facing side of control playing piece 62 oriented according to the will of the first player. Then, the players sequentially place die playing pieces 38 onto die placement spaces 22 adjacent to either control playing piece 62 or one of die playing pieces 38. The colored pattern on each die playing piece 38 top facing side 40 is then oriented according to the will of the player initially playing that particular playing piece. The game continues with a player optionally reorienting a row of playing pieces 38 located on a row of die placement spaces 22 whenever that player deposits a playing piece at an end of a row of playing pieces so that each of the die playing pieces 38 at each end of the row thus formed has a colored pattern on top facing side 40 that is oriented with that player's game color facing toward that player. This row reorientation comprises rotating each playing piece in the row so that the colored pattern on top facing side 40 of each playing piece 38 has the player's color facing that player. Play continues in the game until all playing pieces 38 are deposited onto game board 10. In the course of play, certain high scoring zones 34 may be encircled by a single player. In that case, if the encircling playing pieces are color oriented toward the player's game color, then high scoring or bonus point advantage would accrue to that player. In any event, the end of play is determined when all playing pieces have been deposited onto the game board and then the calculation of each player's score occurs. This calculation is performed by counting the number of die playing pieces 38 having colored patches 68 on top facing side 40 with a player's selected game color facing toward that player.

The invention accordingly consists in the features of the construction, combinations of elements, arrangements of parts, and method of play which will be exemplified in the construction and methods described above and of which the scope of the invention would be indicated in the following claims. It is to be understood that while certain embodiments of the present invention have been illustrated and described, the invention is not to be limited to the specific forms or arrangements of parts or steps herein described and shown.

What is claimed is:

1. A game having as its object the orientation of rows of playing pieces to accumulate points for players, the game comprising:

(a) a game board with a playing surface having indicia including:

(i) colored peripheral regions which denote individual player locations and assigned game colors;

(ii) a symmetric pattern of playing piece placement spaces defined by a plurality of separation regions, the separation regions being arranged so that the playing piece placement spaces are linearly oriented to form rows of placement spaces;

(b) a plurality of playing pieces sized for placement on the game board playing surface placement spaces, each playing piece comprising multiple sides, and each playing piece side having a colored pattern comprising multiple colors;

(c) a control playing piece shaped for placement on one of the game board placement spaces and used for controlling priority of player moves and for placement within a row of playing pieces located on placement spaces;

(d) whereby players may in turn position the playing pieces for scoring advantage through orienting rows of the playing pieces so that the color of a designated portion of each playing piece is aligned toward a player's colored peripheral region.

2. A game according to claim 1 wherein the game board comprises thirty seven playing piece placement spaces.

3. A game according to claim 1 wherein the rows of die placement spaces comprise vertical, horizontal, and diagonal rows in relation to each player and to adjacent rows.

4. A game according to claim 1 wherein the game board indicia comprises a plurality of high scoring zones located between four adjacent separation regions.

5. A game according to claim 1 wherein each playing piece comprises a cubic playing piece having six sides.

6. A game according to claim 5 wherein the colored pattern on each of the six sides of each cubic playing piece is differently arranged than on any other side of any one cubic playing piece.

7. A game according to claim 6 wherein the colored pattern on each playing piece side comprises four color patches each of a different color.

8. A game according to claim 5 wherein the cubic playing pieces each comprise eight corner sections having inner surfaces and outer surfaces, the inner surfaces of each corner section comprising multiple protruding dowel members and multiple dowel receiving apertures, the eight corner sections being constructed and arranged for assembly into a single six sided cubic playing piece by insertion of the dowel members of adjacent corner sections into opposing dowel receiving apertures.

9. A game according to claim 8 wherein the outer surfaces of each corner section of said six sided cubic playing piece comprise approximately one quarter of the area of each of three sides of the playing piece.

10. A game according to claim 5 wherein the cubic playing pieces each comprise cubic corner sections having inner and outer surfaces, the cubic corner sections being constructed and arranged for assembly into a single cubic playing piece, each corner section outer surfaces comprising at least one quarter of the area of each of three sides of an assembled playing piece.

11. A six sided cubic playing piece for use in a board game of strategy comprising eight corner sections each having inner surfaces and outer surfaces, the inner surfaces of each corner section comprising multiple protruding dowel members and multiple dowel receiving apertures, the eight corner sections being constructed and arranged for snap-fit assembly into a cubic playing piece by insertion of the dowel members of adjacent corner sections into opposing dowel receiving apertures.

12. A six sided cubic playing piece according to claim 11 wherein the outer surfaces of each corner section comprise approximately one quarter of the area of each of three sides of the playing piece.

13. A six sided cubic playing piece according to claim 12 wherein the outer surfaces of a playing piece corner section comprise identical colors.

14. A six sided cubic playing piece according to claim 13 wherein each of the six sides comprises a colored pattern having four different colors.

15. A method of playing a board game wherein the game comprises a game board with a playing surface having indicia including four colored peripheral regions which denote individual player locations and assigned game colors, and a symmetric pattern of die placement spaces defined by a plurality of separation regions, the separation regions being arranged so that the die placement spaces are linearly oriented to form rows of die placement spaces, and a plurality of cubic die playing pieces sized for selective placement on the game board playing surface die placement spaces, each die playing piece comprising six sides with each side having a colored pattern comprising four different colors, and a control playing piece shaped for placement on a die placement space and used for controlling priority of player moves and for placement within a row of playing pieces located on die placement spaces, the method comprising the steps of:

(a) each player selecting one of the four colored peripheral regions on the game board and self-locating so that the selected region is in front of that player;

(b) determining the sequence of player moves;

(c) the first player depositing the control playing piece on a die placement space at the center of the game board with the colored pattern on the top facing side being oriented according to the will of the first player;

(d) sequentially placing die playing pieces on die placement spaces adjacent to either the control playing piece or a die playing piece with the colored pattern on each die playing piece top facing side being oriented according to the will of the player initially playing that particular die playing piece; and (e) a player optionally reorienting a row of playing pieces located on a row of die placement spaces whenever that player deposits a playing piece at an end of a row of playing pieces so that each of the two die playing pieces at each end of the row has a colored pattern on the top facing side that is oriented with the player's selected color facing toward that player, the row reorientation comprising rotating each playing piece in the row so that the colored pattern on the top facing side of each playing piece has the player's color facing that player.

16. The method according to claim 15 further comprising the steps of:

(a) sequentially depositing all playing pieces onto the game board; and (b) calculating each player's score by counting the number of die playing pieces having a colored pattern on the top facing side oriented so that a player's selected color is facing toward that player.

17. A method of playing a board game wherein the game comprises a game board with a playing surface having indicia including four colored peripheral regions which denote individual player locations and assigned game colors, and a symmetric pattern of die placement spaces defined by a plurality of separation regions, the separation regions being arranged so that the die placement spaces are linearly oriented to form rows of die placement spaces, and a plurality of high scoring zones located between four adjacent separation regions, and a plurality of cubic die playing pieces sized for selective placement on the game board playing surface die placement spaces, each die playing piece comprising six sides with each side having a colored pattern comprising four different colors, and a control playing piece shaped for placement on a die placement space and used for controlling priority of player moves and for placement within a row of playing pieces located on die placement spaces, the method comprising the steps of:

(a) each player selecting one of the four colored peripheral regions on the game board and self-locating so that the selected region is in front of that player;

(b) determining the sequence of player moves;

(c) the first player depositing the control playing piece on a die placement space at the center of the game board with the colored pattern on the top facing side being oriented according to the will of the first player;

(d) sequentially placing die playing pieces on die placement spaces adjacent to either the control playing piece or a die playing piece with the colored pattern on each die playing piece top facing side being oriented according to the will of the player initially playing that particular die playing piece;

(e) a player optionally reorienting a row of playing pieces located on a row of die placement spaces whenever that player deposits a playing piece at an end of a row of playing pieces so that each of the two die playing pieces at each end of the row has a colored pattern on the top facing side that is oriented with the player's selected color facing toward that player, the row reorientation comprising rotating each playing piece in the row so that the colored pattern on the top facing side of each playing piece has the player's color facing that player;

(f) sequentially depositing all playing pieces onto the game board; and (g) calculating each player's score by counting the number of die playing pieces having a colored pattern on the top facing side with a player's selected color facing toward that player and counting the number of high scoring zones immediately surrounded by a player's scoring playing pieces.

* * * * *